US009829009B2

(12) United States Patent
Seccareccia

(10) Patent No.: US 9,829,009 B2
(45) **Date of Patent: *Nov. 28, 2017**

(54) CENTRIFUGAL CEILING FAN

(71) Applicant: Sectar Solutions Inc., Montreal (CA)

(72) Inventor: Alessandro Seccareccia, Montreal (CA)

(73) Assignee: P.A.C. INTERNATIONAL INC., Laval, Quebec (CA)

( * ) Notice: Subject to any disclaimer, the term of this patent is extended or adjusted under 35 U.S.C. 154(b) by 307 days.

This patent is subject to a terminal disclaimer.

(21) Appl. No.: 14/664,106

(22) Filed: Mar. 20, 2015

(65) Prior Publication Data

US 2015/0192146 A1 Jul. 9, 2015

Related U.S. Application Data

(63) Continuation of application No. 13/500,061, filed as application No. PCT/CA2010/001748 on Nov. 1, 2010, now Pat. No. 9,022,731.

(Continued)

(51) Int. Cl.
*F04D 17/16* (2006.01)
*F04D 29/42* (2006.01)

(Continued)

(52) U.S. Cl.
CPC ..... *F04D 29/4246* (2013.01); *F04D 13/06* (2013.01); *F04D 17/16* (2013.01);

(Continued)

(58) Field of Classification Search
CPC .... F04D 17/16; F04D 25/088; F04D 29/2238; F04D 29/2255; F04D 29/242;

(Continued)

(56) References Cited

U.S. PATENT DOCUMENTS 1,354,673 A 10/1920 Mathis
1,378,008 A 5/1921 Candee (Continued)

FOREIGN PATENT DOCUMENTS

CA 2451949 6/2005
DE 19531160 2/1997

(Continued)

OTHER PUBLICATIONS

Sectar Solutions Inc, European Application No. EP10827757, Supplementary European Search Report, May 4, 2015.

(Continued)

*Primary Examiner* — Ninh H Nguyen
(74) *Attorney, Agent, or Firm* — Michael G. Johnston; Moore & Van Allen, PLLC

(57) ABSTRACT

The present document describes a centrifugal ceiling fan. The fan comprises a casing, a motor and a centrifugal propeller. The casing comprises an upper surface comprising an air inlet and a lower surface comprising an air outlet. In an embodiment, the lower surface has a round bowl-like shape including a plurality of openings defining the air outlet. The propeller comprises a shaft and a plurality of blades provided around the shaft. The blades may be curved to push the air in all directions between a first direction substantially perpendicular to the rotation shaft and a second direction substantially parallel to the rotation shaft in order to evenly ventilate the room. The fan may include a heating element for heating the air as it exits from the fan.

19 Claims, 9 Drawing Sheets

Related U.S. Application Data

(60) Provisional application No. 61/257,594, filed on Nov. 3, 2009.

(51) Int. Cl.

| | |
|---|---|
| ***F04D 25/08*** | (2006.01) |
| ***F04D 29/58*** | (2006.01) |
| ***F24H 3/04*** | (2006.01) |
| ***F04D 29/28*** | (2006.01) |
| ***F04D 13/06*** | (2006.01) |
| ***F04D 29/44*** | (2006.01) |

(52) U.S. Cl.
CPC ..... *F04D 25/088* (2013.01); *F04D 29/281* (2013.01); *F04D 29/4226* (2013.01); *F04D 29/441* (2013.01); *F04D 29/584* (2013.01); *F24H 3/0405* (2013.01)

(58) Field of Classification Search
CPC ..... F04D 29/281; F04D 29/30; F04D 29/325; F04D 29/384; F04D 29/4213; F24H 3/0405; F05D 2250/52
See application file for complete search history.

(56) References Cited

U.S. PATENT DOCUMENTS 1,478,909 A 12/1923 Oswald
1,501,201 A * 7/1924 Cates ..... F04D 25/088 416/194
1,513,763 A 11/1924 Rowe
1,730,372 A 8/1927 Lawrie
1,657,758 A 1/1928 Lum
1,699,201 A 1/1929 Guth
2,037,880 A 4/1936 Charavay
2,083,996 A 6/1937 Jonn
2,138,814 A 12/1938 Bressler
2,237,451 A 4/1941 Samuels
2,269,049 A 1/1942 Zellweter
2,287,853 A 6/1942 Allardice
2,491,399 A 12/1949 Thompson
2,916,199 A 12/1959 Loehr
2,958,460 A 11/1960 Bullock
3,171,586 A 3/1965 Ariewitz
3,368,744 A 2/1968 Jen
3,398,883 A 8/1968 Ariewitz
3,459,366 A 8/1969 Schroeter
3,619,088 A 11/1971 Bullock
3,856,434 A 12/1974 Hoffmann
4,108,568 A 8/1978 Townsend
4,165,950 A 8/1979 Masai et al.
4,276,816 A 7/1981 Tuley
4,342,258 A 8/1982 Zaniewski
4,473,000 A 9/1984 Perkins
4,508,958 A 4/1985 Kan et al.
4,526,506 A 7/1985 Köger et al.
4,598,632 A 7/1986 Johnson, III
4,640,668 A * 2/1987 Yang ..... F04D 25/088 310/68 E
4,647,506 A 3/1987 Colon et al.
4,693,673 A 9/1987 Nee
4,768,424 A 9/1988 Frenkler et al.
4,867,643 A 9/1989 Appleton
4,915,583 A 4/1990 Vera et al.
5,336,050 A 8/1994 Guida et al.
5,513,953 A 5/1996 Hansen
5,599,169 A 2/1997 Hauser
5,668,920 A 9/1997 Pelonis
5,707,209 A 1/1998 Iyer et al.
5,755,555 A 5/1998 Swift
5,860,788 A 1/1999 Sorensen
5,927,947 A 7/1999 Botros
5,964,576 A 10/1999 Fujita et al.
5,980,207 A 11/1999 Correll
6,004,365 A 12/1999 Fiacco
6,039,539 A 3/2000 Berg
6,042,335 A 3/2000 Amr
6,123,618 A 9/2000 Day
6,217,285 B1 4/2001 Kurokawa et al.
6,224,335 B1 5/2001 Parisi et al.
6,240,247 B1 5/2001 Reiker
6,283,726 B1 9/2001 Fackelmann et al.
6,299,409 B1 10/2001 Matsunaga
6,358,011 B1 3/2002 Tetu et al.
6,372,005 B1 4/2002 Fiacco
6,395,843 B2 * 5/2002 Maekawa ..... C08G 18/0895 525/440.04
6,438,322 B1 8/2002 Reiker
6,477,321 B2 11/2002 Reiker
6,514,304 B2 2/2003 Fiacco
6,558,120 B2 5/2003 Kim et al.
6,568,905 B2 5/2003 Horng et al.
6,631,243 B2 10/2003 Reiker
6,632,132 B1 10/2003 Kikuchi et al.
6,634,855 B1 10/2003 Rollo
6,669,556 B2 12/2003 Gautney
6,685,433 B2 2/2004 Kim et al.
6,751,406 B2 6/2004 Reiker
6,755,615 B2 6/2004 Chapman
6,769,876 B2 8/2004 Sakai et al.
6,798,098 B1 9/2004 Tai
6,942,459 B2 9/2005 Li et al.
6,945,868 B2 9/2005 Gautney
7,061,758 B2 6/2006 Liu et al.
7,066,712 B2 6/2006 Kim et al.
7,070,389 B2 7/2006 Kim et al.
7,121,799 B2 10/2006 Kim et al.
7,125,226 B2 10/2006 Horng et al.
7,192,254 B2 3/2007 Li et al.
7,210,907 B2 5/2007 Patti
7,244,099 B2 7/2007 Yamasaki
7,246,997 B2 7/2007 Liu et al.
7,281,898 B2 10/2007 Baek et al.
7,381,129 B2 6/2008 Avedon
7,467,931 B2 12/2008 O'Toole
9,022,731 B2 * 5/2015 Seccareccia ..... F04D 17/16 415/126
2005/0103042 A1 5/2005 Sanagi
2005/0233688 A1 10/2005 Franz
2006/0128299 A1 6/2006 Wu
2006/0172688 A1 8/2006 Johnson
2007/0014666 A1 1/2007 White
2007/0066215 A1 3/2007 Song et al.
2007/0092375 A1 4/2007 Liu
2007/0110574 A1 5/2007 Lu et al.
2007/0128039 A1 6/2007 Fan et al.
2007/0140836 A1 6/2007 Chao et al.
2007/0217908 A1 9/2007 Ochiai et al.
2007/0243819 A1 10/2007 Ladanyi
2007/0247854 A1 10/2007 Lin
2007/0253834 A1 11/2007 Ogino et al.
2008/0019824 A1 1/2008 Jiang et al.
2008/0095629 A1 4/2008 Eguchi et al.
2008/0107528 A1 5/2008 Tsuji et al.
2008/0134713 A1 6/2008 Choi et al.
2008/0159865 A1 7/2008 Lee et al.
2008/0226452 A1 9/2008 Weaver
2008/0227381 A1 9/2008 Avedon
2008/0232967 A1 9/2008 Salvesen
2008/0286130 A1 11/2008 Purvines
2009/0028713 A1 1/2009 Kikuchi et al.
2009/0028719 A1 1/2009 Teraoka et al.
2009/0092488 A1 4/2009 Weaver
2011/0223007 A1 9/2011 Hammel et al.
2013/0028759 A1 1/2013 Berroth

FOREIGN PATENT DOCUMENTS

DE 102007040794 3/2009
EP 723510 7/1996
EP 1457683 9/2004
EP 1878923 A 1/2008
EP 1933040 6/2008

(56) References Cited

FOREIGN PATENT DOCUMENTS

| | | | |
|---|---|---|---|
| EP | 2008255920 | | 10/2008 |
| GB | 702084 | | 1/1954 |
| GB | 1107270 | | 3/1968 |
| GB | 11771961 | | 11/1969 |
| GB | 1420674 | | 1/1976 |
| GB | 2289090 | | 11/1995 |
| GB | 2300676 | | 11/1996 |
| GB | 2312023 | | 10/1997 |
| GB | 2459063 | A | 10/2009 |
| JP | 59001935 | | 6/1982 |
| JP | 2009138587 | | 6/2009 |
| WO | 2004011854 | A1 | 2/2004 |
| WO | WO 2008/011368 | A | 1/2008 |
| WO | 2011054093 | A1 | 5/2011 |

OTHER PUBLICATIONS

Sectar Solutions Inc., International Patent Application No. PCT/CA2015/050757, International Search Report, dated Nov. 4, 2015.

* cited by examiner

CENTRIFUGAL CEILING FAN

CROSS-REFERENCE TO RELATED APPLICATIONS

This application is continuation from U.S. application Ser. No. 13/500,061 which is a national phase entry of PCT/CA2010/001748 filed on Nov. 1, 2010 which claims priority from U.S. Provisional Application No. 61/257,594 filed on Nov. 3, 2009 which are incorporated herein by reference in their entirety.

BACKGROUND (a) Field

The subject matter disclosed generally relates to ceiling fans.

(b) Related Prior Art

FIG. 1 illustrates a conventional axial ceiling fan 20. The ceiling fan 20 includes a plurality of paddles 22, a lamp 24, a motor 26 for turning the paddles 22, and attachment means 28 for attaching the ceiling fan 20 to the roof.

This type of fans has several problems. One of the problems is the uneven distribution of air throughout the room. The paddles are mounted vertically to the axis of rotation and push the air downward in the same direction as the axis of rotation. Therefore, the area outside the radius of the paddles remains unventilated. Other problems associated with axial fans include the space occupied by the paddles and the safety concerns due to the fact that the paddles are exposed as they rotate.

Several attempts have been made to address this problem. For example U.S. Patent Publication No. 2007/0247854 describes a ceiling fan in which the paddles are covered by a casing as shown in FIG. 2. The solution described in this reference addresses only the safety concern. However, the space occupied is substantially the same or even greater than that of FIG. 1, and the lack of even distribution of air remains the same.

One way for reducing the size of the fan, is to make the paddles shorter. Thus, to obtain the same ventilation results, the rotation speed has to be increased, which results in an increase in energy consumption and noise.

Other attempts to address these problems are described in U.S. Pat. No. 1,699,201; U.S. Pat. No. 4,473,000; U.S. Pat. No. 4,768,424, U.S. Pat. No. 7,381,129 etc. These references address one problem on the expense of the other.

Therefore, there is a need for a ventilation system which is efficient, safe to use, quiet, and provides even distribution of air throughout the room.

SUMMARY

According to an embodiment, there is provided a centrifugal ceiling fan which comprises a centrifugal impeller instead of paddles for forced air current. This centrifugal impeller will be encased, thus eliminating any exterior rotating parts. This configuration will make the fan safer, considering that the paddles create a danger to any object nearing the device.

According to a first aspect, there is provided a centrifugal ceiling fan comprising: a casing comprising an upper surface comprising an air inlet and a lower surface comprising an air outlet, said lower surface comprising an upper section and a lower section and having a variable diameter between said upper and lower sections, said diameter being greater at the upper section than the lower section. The fan also comprises a centrifugal propeller comprising a rotation shaft and a plurality of blades provided around said shaft, said blades being curved to push the air in substantially all directions between a first direction substantially perpendicular to the rotation shaft and a second direction substantially parallel to the rotation shaft; and a motor operatively connected to said centrifugal propeller for rotating said centrifugal propeller; said motor and said centrifugal propeller being provided within said casing. Rotation of the centrifugal propeller causes air to be received from said air inlet and to be pushed from said air outlet in substantially all directions between the first direction and the second direction.

In an embodiment, the blades have a variable width corresponding to the variable diameter.

In another embodiment, the lower surface has a bowl-like shape.

In a further embodiment the upper section and the lower section are connected by linking members. In yet a further embodiment, at least one of the linking members is provided with a heating element for heating the air. In another embodiment, at least one heating element is provided between two linking members for heating the air.

The casing may comprise an air regulator provided at an outer side of the casing. In this embodiment, the air regulator may comprise a plurality of rings having different diameters provided between the upper section and the lower section for directing the air. In one embodiment, the space between at least two rings is adjustable. In another embodiment, the angle of orientation of at least one ring is adjustable.

The upper surface may be provided as a lid and the upper section of the lower surface may include an opening for receiving said lid.

In an embodiment, the centrifugal propeller comprises an upper plate and a lower plate connected to the rotation shaft, said upper and lower plates having openings therein for receiving an upper edge and a lower edge of each blade, respectively. In this embodiment, the centrifugal fan may comprise a motor having a cylindrical shape and comprising a flange between a first and a second end thereof; a static plate which rests on an inner side of the casing above said upper plate, said static plate comprising an opening therein, said opening having a diameter which is greater than a diameter of said motor and smaller than a diameter of said flange; wherein the motor is supported by said static plate using said flange and a portion of said motor below said flange passes through said opening for connection to the centrifugal propeller.

In an embodiment, a plurality of spacers are provided between the motor and the portion of said motor above the flange for maintaining said motor in position.

In a further embodiment, direction of air is substantially perpendicular to the rotation shaft in proximity of the upper section, and substantially parallel to the rotation shaft in proximity of the lower section.

In another aspect, there is provided a centrifugal ceiling fan comprising: a casing comprising an upper surface comprising an air inlet and a lower surface comprising an air outlet; a centrifugal propeller operatively connected to a motor for generating an air current, said propeller and said motor being provided within said casing; and an air regulator provided at an outer side of said casing for directing said air current.

In an embodiment, the air regulator comprises a plurality of rings which are spaced apart from and placed one over the other between an upper section and a lower section of the lower surface.

In an embodiment, a space between at least two of the rings is adjustable. In another embodiment, an orientation of at least one of the rings is adjustable.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENTS

In embodiments there is disclosed a centrifugal ceiling fan. The fan comprises a casing, a motor and a centrifugal propeller. The casing comprises an upper surface comprising an air inlet and a lower surface comprising an air outlet. In an embodiment, the lower surface has a round bowl-like shape including a plurality of openings defining the air outlet. The propeller comprises a shaft and a plurality of blades provided around the shaft. The blades may be curved to push the air in all directions between a first direction substantially perpendicular to the rotation shaft and a second direction substantially parallel to the rotation shaft in order to evenly ventilate the room. The fan may include a heating element for heating the air as it exits from the fan.

Figure 1:
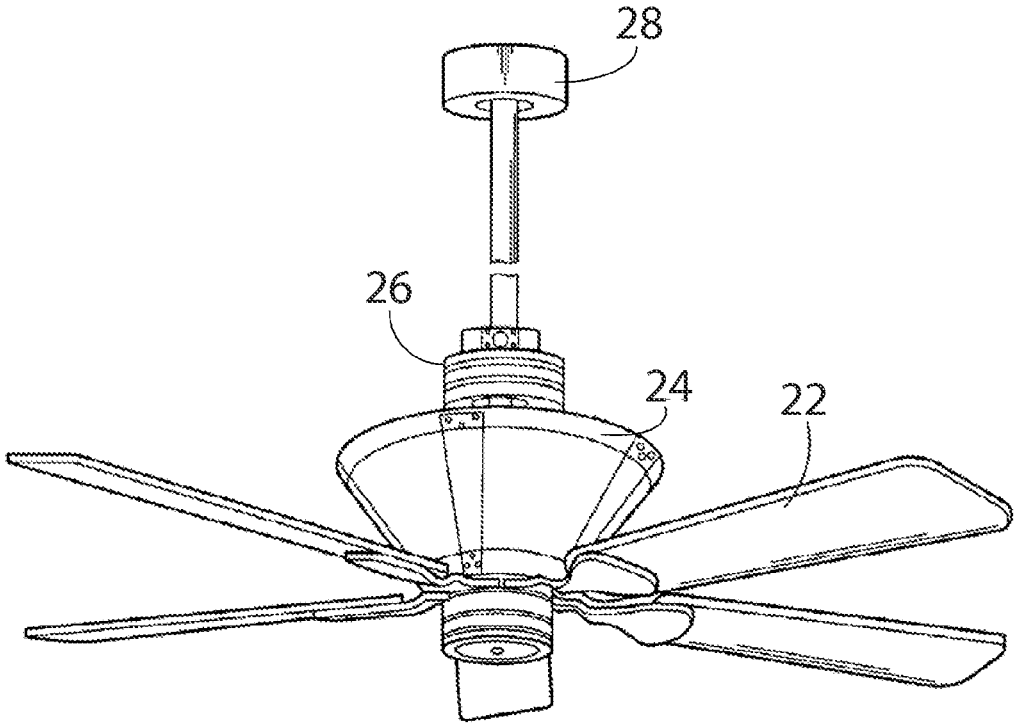
FIGURE 1 PRIOR ART
FIG. 1 illustrates a conventional axial ceiling fan.
Figure 2:
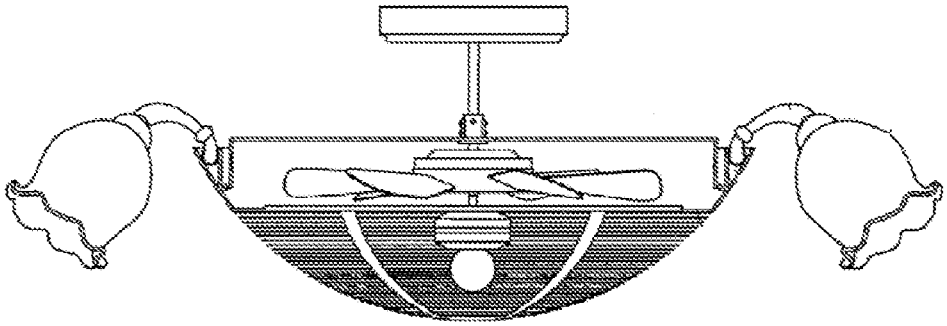
FIGURE 2 PRIOR ART
FIG. 2 illustrates a conventional axial ceiling fan with a casing.
Figure 3:
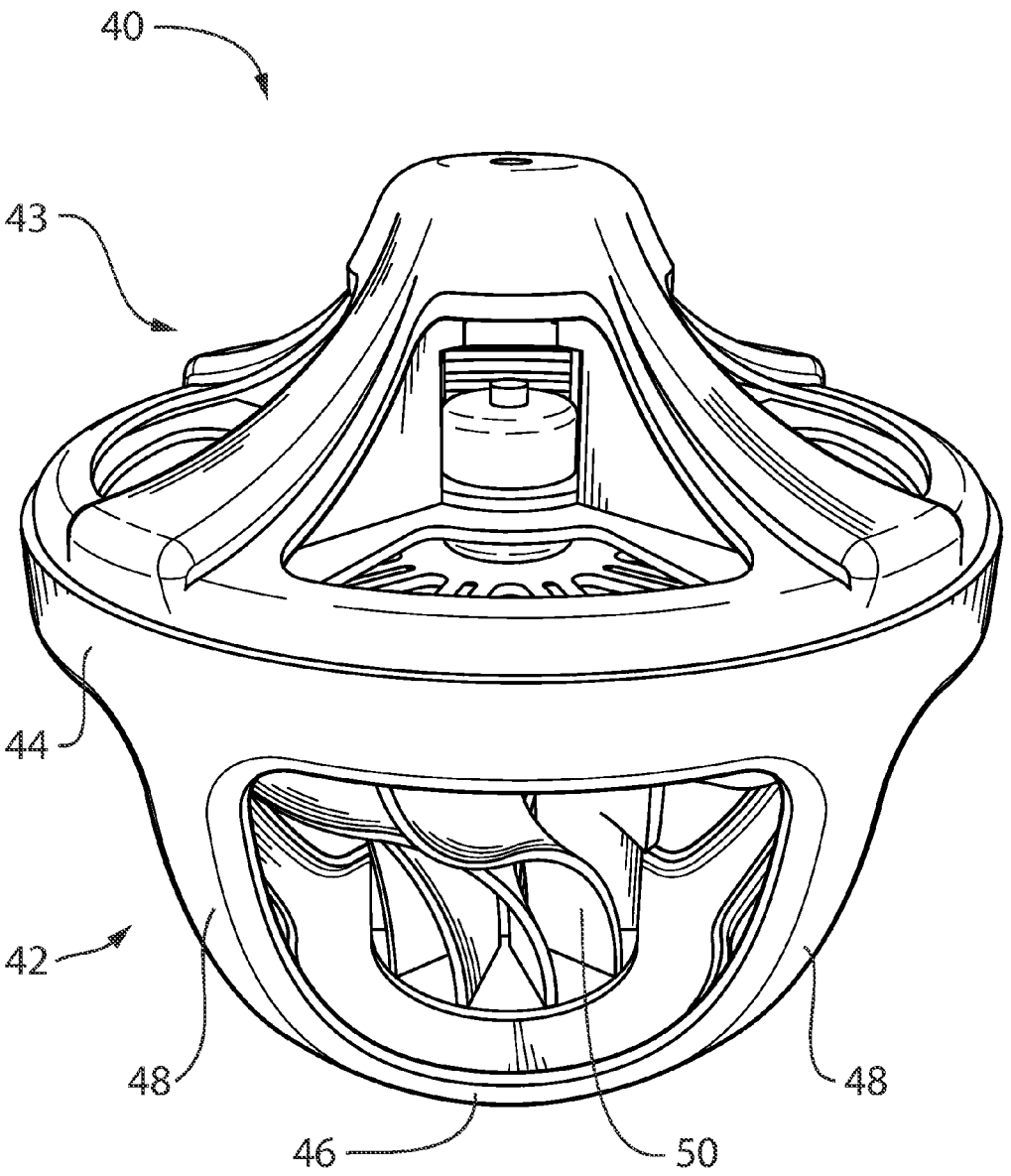
FIG. 3 illustrates a centrifugal ceiling fan in accordance with an embodiment.

Referring now to the drawings, FIG. 3 illustrates an example of a centrifugal ceiling fan in accordance with an embodiment. As shown in FIG. 3, the centrifugal ceiling fan 40 includes a casing. In an embodiment, the casing has a round shape and comprises a lower bowl-like portion 42 comprising an air outlet, and an upper portion 43 defining a lid and comprising an air inlet. The lower portion 42 comprises an upper section 44, and a lower section 46. The lower portion has a variable diameter whereby, the diameter is larger at the upper section 44 than at the lower section 46. The upper and lower sections are connected by a plurality of linking members 48. The linking members 48 are spaced apart to define openings therebetween. The openings may extend between the upper section 44 and the lower section 46.

The centrifugal ceiling fan 40 comprises a centrifugal impeller 52, and an electric motor 50 (Shown in FIG. 4) for rotating the impeller 52. The ceiling fan 40 may be attached to the ceiling using known attachment means through the upper end of the lid 43. Clasps or equivalent fastening means may be used for attachment of the entire apparatus to an electrical ceiling box.

Figure 4:
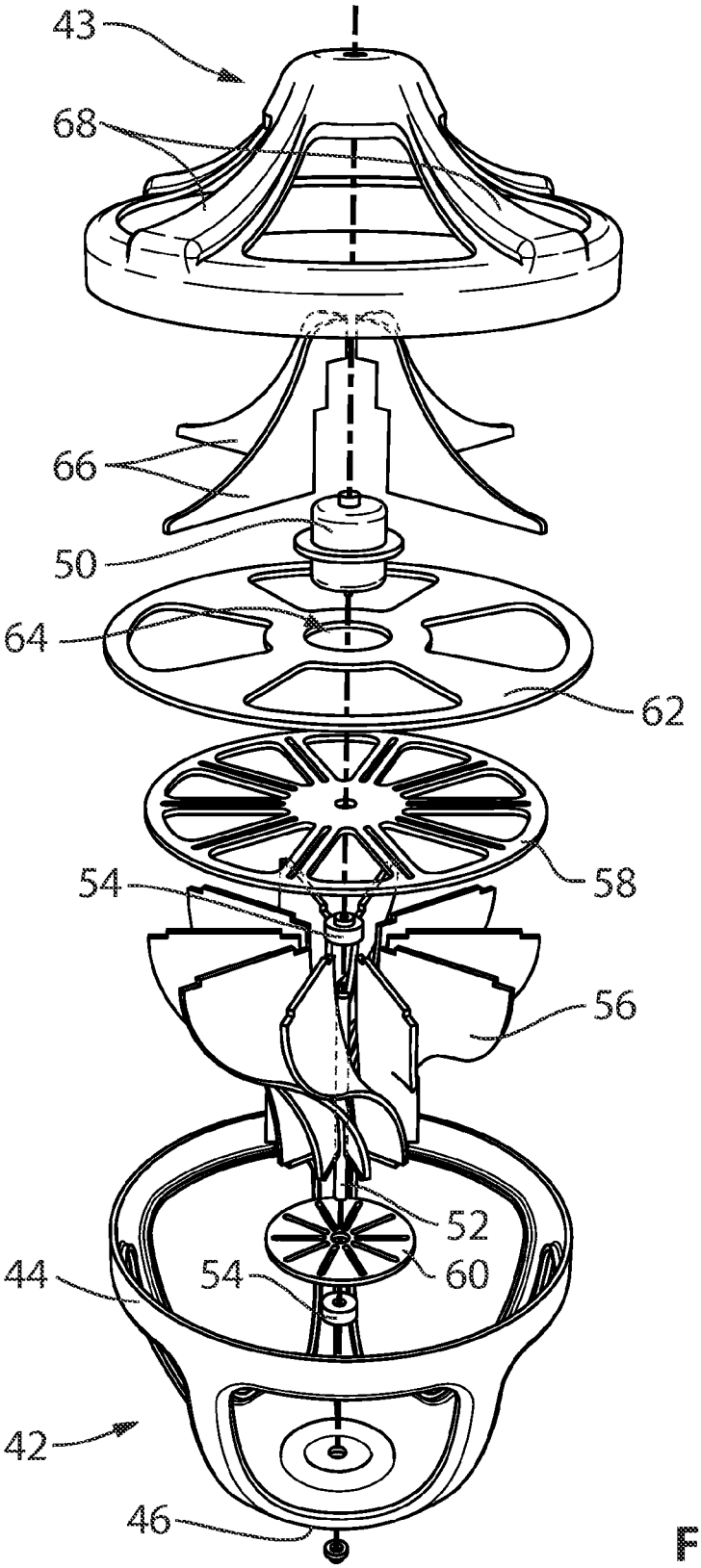
FIG. 4 is an exemplary exploded view of the centrifugal ceiling fan illustrated in FIG. 3.

FIG. 4 is an exemplary exploded view of the centrifugal ceiling fan illustrated in FIG. 3. As shown in FIG. 4, the impeller 52 comprises a rotation shaft 52 connected between two nuts 54, and a plurality of blades 56 provided angularly around the rotation shaft 52 between an upper plate 58 and a lower plate 60. In an embodiment, the upper and lower plates 58 and 60 include a plurality of openings for receiving the upper and lower ends of the blades, respectively.

In the present embodiment, the electric motor 50 has a cylindrical shape and includes a flange between the two ends thereof. A static plate 62 is provided between the upper plate 58 and the lid 43 for supporting the motor 50. The static plate 62 rests on the inner side of the casing and includes an opening 64 having a diameter which is slightly greater than the diameter of the motor and smaller than the diameter of the flange for receiving the portion of the motor which is under the flange. In an embodiment, a plurality of spacers 66 is provided between the lid 43 and the plate 62 for holding the motor 50 in place within the casing. As shown in FIG. 4, the spacers 66 are dimensioned to receive the upper portion of the motor above the flange. It should be noted that, while advantageous, the provision of the spacers 66 is optional because the lid itself 43 may be shaped to maintain the motor 50 in place.

As shown in FIG. 4, the upper section 44 of the casing 40 defines an opening for receiving the lid 43. The lid 43 includes a plurality of ribs 68 connected between the upper surface and the lower surface thereof. The ribs 68 are spaced apart to define openings therebetween. The upper plate 58 and the static plate 62 also include a plurality of cutouts, as shown in FIG. 4 for letting the air pass therethrough.

Figure 5:
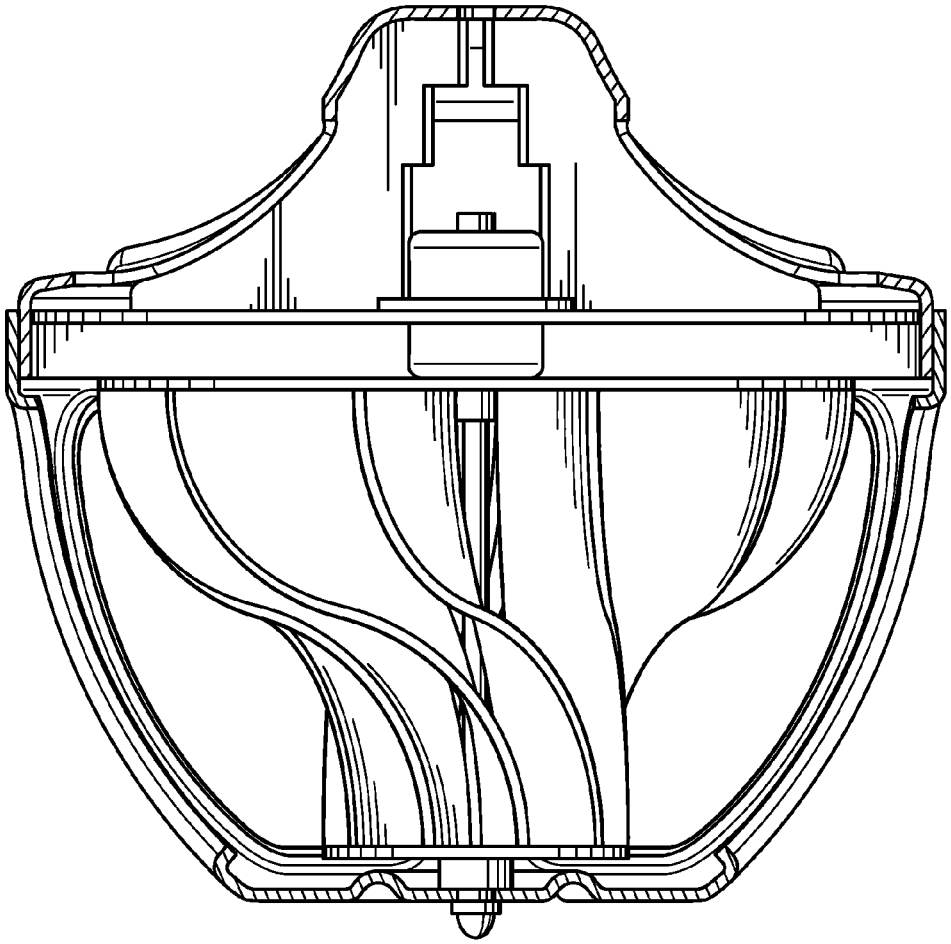
FIG. 5 illustrates examples of how the blades of the ceiling fan may be curved, in accordance with an embodiment.
Figure 6:
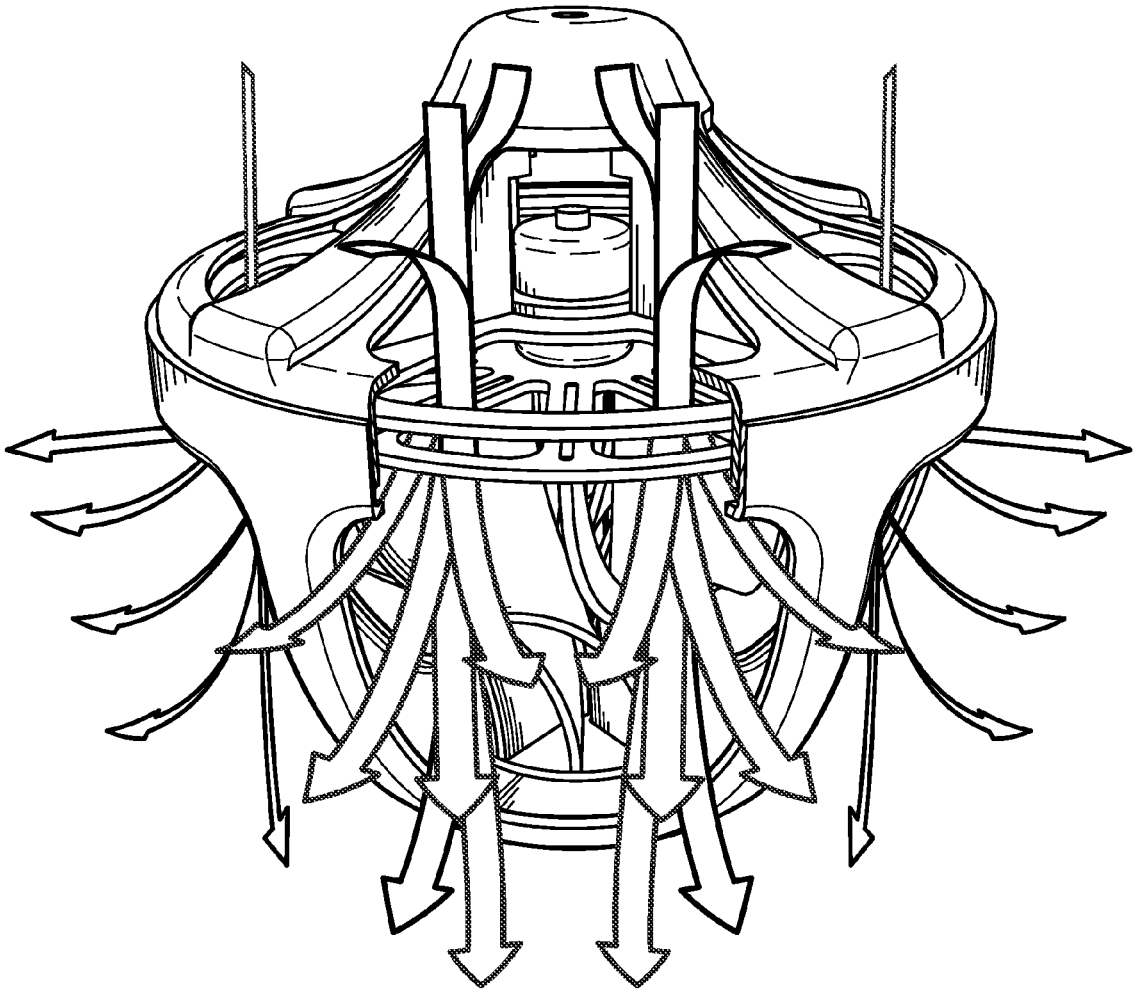
FIG. 6 illustrates an example of the even flow of air through the ceiling fan illustrated in FIG. 3.

In order to evenly ventilate the room through the air outlet, the blades may be curved to push the air in substantially all directions between a first direction substantially perpendicular to the rotation shaft and a second direction substantially parallel to the rotation shaft, as shown in FIG. 6. An example of how the blades may be curved is shown in FIG. 5. The blades may have a variable width to fit within the casing. In this case, the width may be larger at the upper edge of the blades than at the lower edge. In an embodiment, the width of the blades corresponds to the diameter of the casing.

During operation, the motor 50 rotates the centrifugal impeller 52. Air is received from the inlet provided in the lid to be directed in all directions between a first direction substantially perpendicular to the rotation shaft and a second direction substantially parallel to the rotation shaft so as to evenly ventilate the room. FIG. 6 illustrates an example of the even flow of air through the ceiling fan illustrated in FIG. 3. As shown in FIG. 6, air is received from the openings provided in the lid 43 through the plate 62, the upper plate 58, and then pushed throughout the room in all directions. The shape of the lower portion 42 which defines the air outlet, and the shape of the blades 56 together allow for an even air distribution of the air throughout the room, as shown in FIG. 6.

In an embodiment, a heating element is provided in the ceiling fan 40 for selectively using the ceiling fan for cooling/heating. The heating element may be placed between the impeller and the casing, thereby allowing the current that exits the casing to be heated. This will have the effect of reducing heating costs, making the centrifugal ceiling fan 40 economical. In an embodiment, the heating element may be provided on the linking members 48. In another embodiment, the heating element may be provided between the linking members or may be provided as a screen at one or more of the openings through which the air exits from the fan 40.

The motor 50 and the heating element are powered by an electric current. The motor 50 and the heating element may operate on different types of currents and voltages. Provision of electric power to the motor and the heating element may be performed using well-known techniques.

The motor 50 may have various speed settings to suit different rooms and meet current needs or desires within a given room. Similarly, the heating element may have various heating settings that suit different rooms and heating needs. Both the motor 50 and the heating element may be controlled remotely from a control panel and/or a remote control which are available on the market.

A variety of the elements described herein e.g. motor, control panel, remote control are available on the market and may be chosen for the purposes described herein, as would be appreciated by a person of skill in the art.

Figure 7:
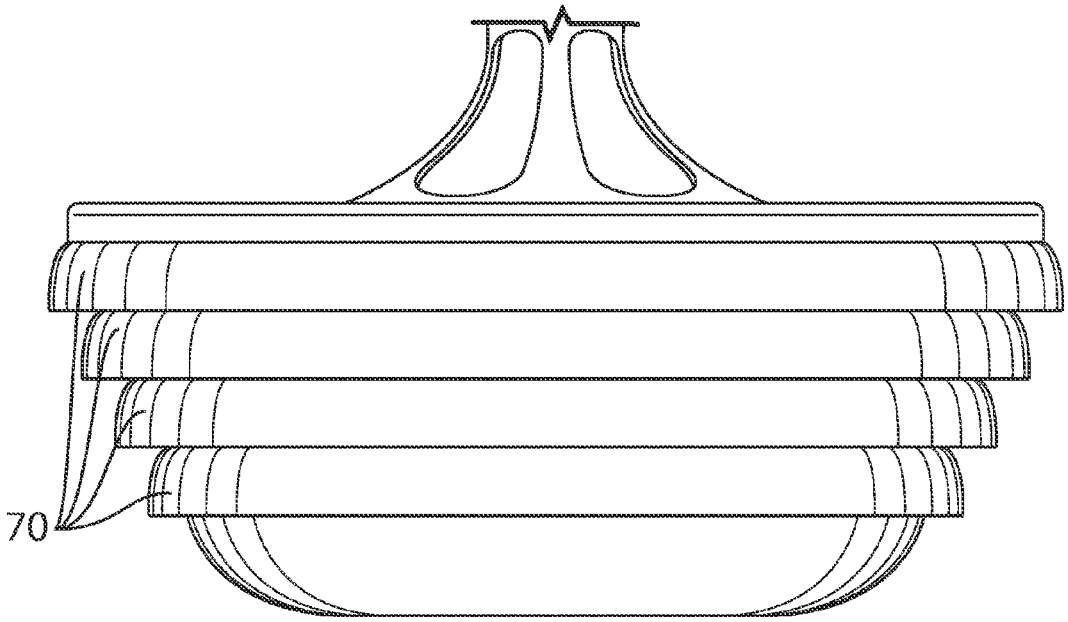
FIG. 7 illustrates a ceiling fan including an air regulator, in accordance with an embodiment.

In another embodiment, the fan may include an air regulator for directing the air current to its desired destination. FIG. 7 illustrates a ceiling fan including an air regulator, in accordance with an embodiment. The air regulator comprises a series of rings 70. The rings 70 are apart from and placed one over the other. These rings 70 are of different radius, the largest ring being the one closest to the upper section 44 and the smallest being the one closer the lower section 46. The rings are angled differently to direct the air in the different directions. In an embodiment, the distance between the rings and/or the angle of each ring may be adjusted by the user manually and/or remotely in accordance with the user's needs, seating area, and/or dimensions of the room. For example when the ceiling is higher than the average, the angle of the rings is diminished so that the air is pushed downward toward the living area rather than perpendicularly toward the walls.

Figure 8:
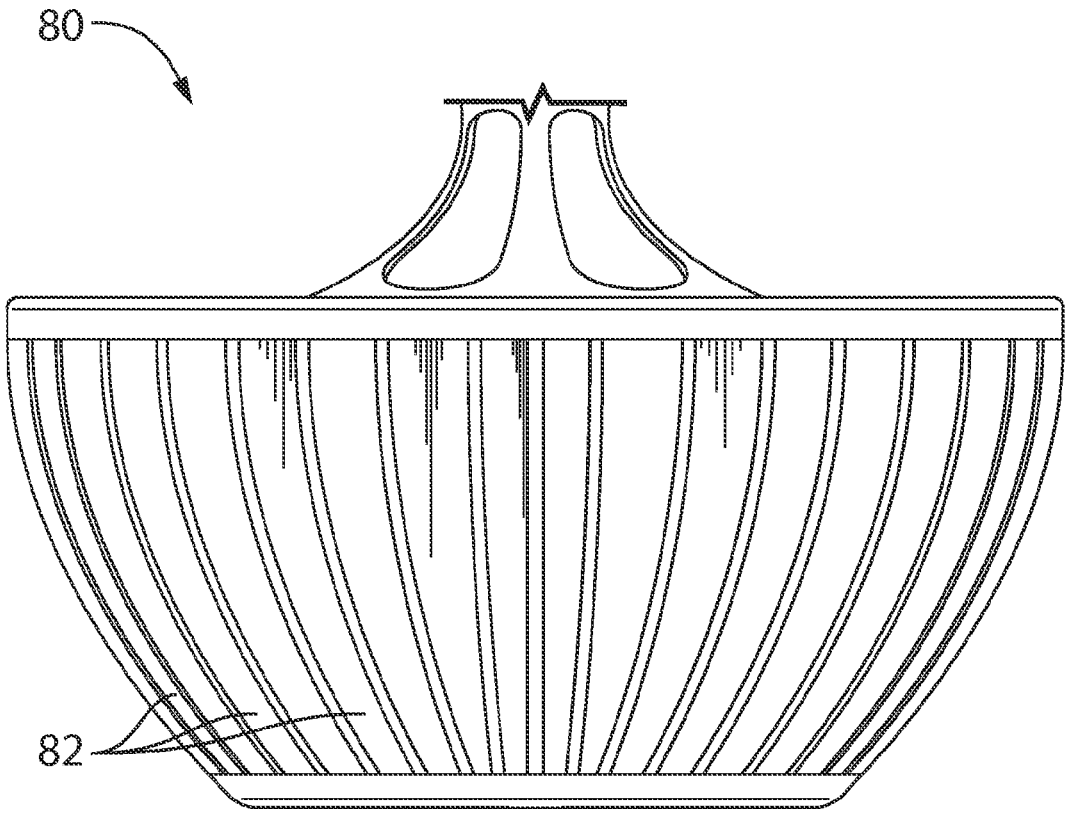
FIG. 8 illustrates a centrifugal ceiling fan including a plurality of rivets, in accordance with an embodiment.

FIG. 8 illustrates a centrifugal ceiling fan 80 including a plurality of rivets 82 around the casing, in accordance with an embodiment. These rivets 82 may be a quarter inch apart, which is enough spacing so as not to create any resistance for the egression of the air current. The impeller directs the air to the desired destination, as described earlier. The centrifugal fan 80 may be aesthetically designed for customer satisfaction. In an embodiment, the rivets may include a heating element for heating the air as it exits from the casing.

Figure 9:
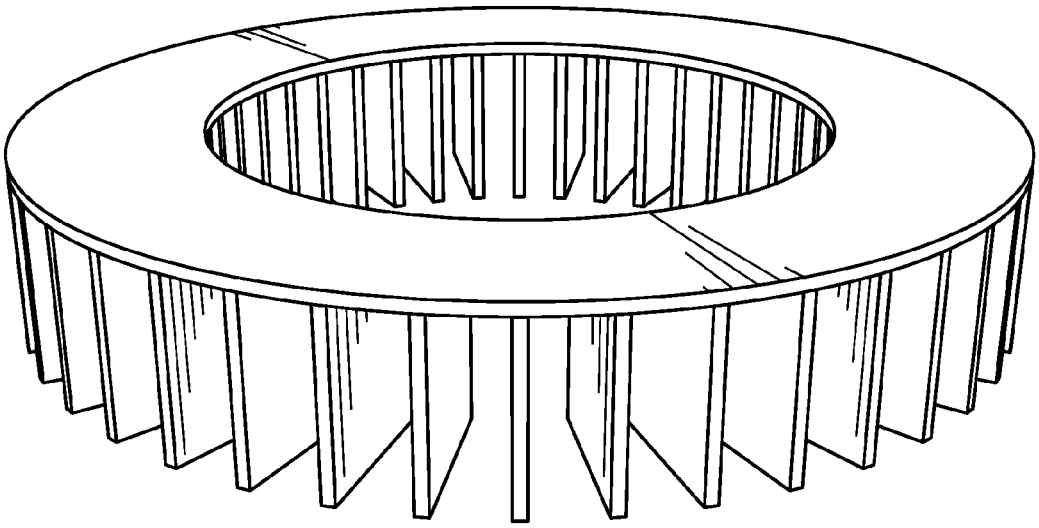
FIG. 9 illustrates an impeller in the form of a hamster wheel, in accordance with an embodiment.

FIG. 9 illustrates an impeller in the form of a hamster wheel, in accordance with an embodiment. In one embodiment, the direction of the current will be determined by the design of the casing and/or the previously described air regulator shown in FIG. 7. In another embodiment, (not shown) the blades of the hamster wheel may be curved to push the air in multiple directions as in the embodiment of FIGS. 3 to 5.

In any one of the above embodiments, the fan may include lighting to allow for simultaneous ventilation and lighting. The lighting is preferably provided at the lower section of the casing.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A centrifugal ceiling fan comprising:

a casing comprising an air inlet and an air outlet;

a centrifugal propeller comprising a rotation shaft and a plurality of blades provided around said shaft, said blades being curved to push the air in substantially all directions between a first direction substantially perpendicular to the rotation shaft and a second direction substantially parallel to the rotation shaft;

a motor operatively connected to said centrifugal propeller to rotate the centrifugal propeller;

wherein rotation of the centrifugal propeller causes air to be received from said air inlet and to be pushed from said air outlet in substantially all directions between the first direction and the second direction.

2. The centrifugal ceiling fan of claim 1, wherein the blades have a width that varies along a direction of the rotation shaft.

3. The centrifugal ceiling fan of claim 2, wherein the blades have a variable width corresponding to the variable diameter.

4. The centrifugal ceiling fan of claim 1, wherein the casing has a diameter that varies along a direction of the rotation shaft.

5. The centrifugal ceiling fan of claim 1, further comprising a heating element for heating the air exiting from the air outlet.

6. The centrifugal ceiling fan of claim 1, further comprising an air regulator for directing the air to a desired location.

7. The centrifugal ceiling fan of claim 6, wherein the air regulator comprises a plurality of rings.

8. The centrifugal ceiling fan of claim 7, wherein a space between at least two rings is adjustable.

9. The centrifugal ceiling fan of claim 7, wherein an angle of orientation of at least one ring is adjustable.

10. The centrifugal ceiling fan of claim 1, wherein the casing comprises an upper surface defining a lid and a lower surface defining an opening for receiving said lid.

11. A centrifugal ceiling fan comprising:

a casing comprising an upper surface comprising an air inlet and a lower surface comprising an air outlet;

a motor;

a centrifugal propeller operatively connected to the motor for generating an air current, the centrifugal propeller comprising a rotation shaft and a plurality of blades provided around said shaft, said blades being curved and have a width that varies along a direction of the rotation shaft.

12. The centrifugal ceiling fan of claim 11, wherein the blades vary in width along the second direction.

13. The centrifugal ceiling fan of claim 11, further comprising an air regulator.

14. The centrifugal ceiling fan of claim 13, wherein the air regulator is adjustable.

15. The centrifugal ceiling fan of claim 13, wherein the air regulator comprises a plurality of rings.

16. The centrifugal ceiling fan of claim 15, wherein an orientation of at least one of the rings is adjustable.

17. The centrifugal propeller of claim 13, wherein the blades vary in width along the second direction.

18. The centrifugal ceiling fan of claim 17, further comprising an air regulator.

19. A centrifugal propeller for installing in a fan comprising a casing defining an air inlet and an air outlet, the centrifugal propeller comprising:

a rotation shaft;

a plurality of blades provided around the rotation shaft; wherein the plurality of blades are curved and dimensioned to push the air in substantially all directions between a first direction substantially perpendicular to the rotation shaft and a second direction substantially parallel to the rotation shaft upon rotation of the rotation shaft.

* * * * *